US006047816A

United States Patent [19]

Moghadam et al.

[11] Patent Number: 6,047,816

[45] Date of Patent: Apr. 11, 2000

[54] PRINTHEAD CONTAINER AND METHOD

[75] Inventors: Omid A. Moghadam, Pittsford; Anthony R. Lubinsky, Penfield; Thomas E. Kocher, Rochester, all of N.Y.

[73] Assignee: Eastman Kodak Company, Rochester, N.Y.

[21] Appl. No.: 09/149,701

[22] Filed: Sep. 8, 1998

[51] Int. Cl.[7] ..... B65D 81/26

[52] U.S. Cl. ..... 206/207

[58] Field of Search ..... 206/205, 207, 206/576, 701, 320; 53/403, 452, 90

[56] References Cited

U.S. PATENT DOCUMENTS

| | | | |
|---|---|---|---|
| 4,165,363 | 8/1979 | Weigert et al. . | |
| 4,384,646 | 5/1983 | Sakamoto et al. . | |
| 4,963,897 | 10/1990 | Kattner . | |
| 4,973,448 | 11/1990 | Carlson et al. | 206/205 X |
| 5,044,495 | 9/1991 | Wyslotsky . | |
| 5,157,421 | 10/1992 | Kitahara . | |
| 5,226,540 | 7/1993 | Bradbury . | |
| 5,365,260 | 11/1994 | Kitani et al. . | |
| 5,455,608 | 10/1995 | Stewart et al. . | |
| 5,459,981 | 10/1995 | Masuda et al. . | |
| 5,477,255 | 12/1995 | Huth . | |
| 5,509,140 | 4/1996 | Koitabashi et al. . | |
| 5,515,663 | 5/1996 | Allgeier et al. . | |
| 5,574,489 | 11/1996 | Cowger et al. . | |
| 5,659,342 | 8/1997 | Lund et al. . | |
| 5,661,510 | 8/1997 | Brandon et al. . | |
| 5,667,063 | 9/1997 | Abe . | |
| 5,709,253 | 1/1998 | Maerzke . | |

*Primary Examiner*—Jacob K. Ackun
*Attorney, Agent, or Firm*—Walter S. Stevens

[57] ABSTRACT

Printhead container and method. The container comprises an enclosure surrounding a printhead body having an ink channel terminating in a nozzle orifice. The ink channel has ink therein. The enclosure is capable of being pressurized to a predetermined internal pressure. The internal pressure acts on the ink to retain the ink in the channel, so that the ink is prevented from flowing along the channel and through the orifice. A one-way valve is in communication with the interior of the enclosure for ingress of a pressurizing medium into the interior of the enclosure, while avoiding reverse flow through the valve in order to allow sustained pressurization of the enclosure. Moreover, a support frame disposed in the enclosure may be provided, the frame defining a well sized to matingly receive the printhead body for constraining movement of the printhead body during transport of the enclosure.

12 Claims, 7 Drawing Sheets

PRINTHEAD CONTAINER AND METHOD

BACKGROUND OF THE INVENTION

This invention generally relates to packaging apparatus and methods and more particularly relates to a container and method for a printhead having ink therein, the container adapted to prevent leakage of the ink from the printhead during transportation or storage of the printhead.

Currently, when an inkjet printhead with an internal ink reservoir is transported from place of manufacture, it is typically transported with no ink in the reservoir. That is, the printhead is typically shipped empty. The printhead is transported empty to avoid spilling of ink during transport. It is only after the printhead reaches its destination, that the user of the printhead fills the reservoir with ink.

However, it is desirable to fill the reservoir before shipping in order to avoid inadvertent introduction of air bubbles and debris into the reservoir when the reservoir is filled by the user. More specifically, introduction of air bubbles and debris into the reservoir can clog ink nozzles formed in a nozzle plate belonging to the printhead, thereby impairing functionality of the printhead. Therefore, a problem in the art is introduction of air bubbles and debris into the reservoir which can clog the ink nozzles thereby impairing functionality of the printhead.

One technique for overcoming this problem is for the manufacturer of the printhead to fill the reservoir and cover the nozzles with adhesive tape before the printhead is shipped to the user. Once the printhead reaches its destination, the user removes the tape before inserting the printhead into the printer. However, removing the tape may damage the nozzle plate, particularly when the nozzles include MEMS (Micro-Electro Mechanical Systems). Also, the adhesive tape may deposit residual amounts of adhesive on the nozzle plate during removal of the tape. Such residual amounts of adhesive may interfere with proper operation of the printhead. Thus, another problem in the art is damage to the MEMS and deposit of residual amounts of adhesive on the nozzle plate as the adhesive tape is removed from the nozzle plate.

It would therefore be desirable to provide a container for an inkjet printhead that assists in retaining ink in the printhead while simultaneously obviating need to place adhesive tape over nozzles to prevent leakage of ink from the printhead during transport or storage of the printhead.

Therefore, there has been a long-felt need to provide a container and method for a printhead having ink therein, the container adapted to prevent leakage of the ink from the printhead during transportation or storage of the printhead.

SUMMARY OF THE INVENTION

An object of the present invention is to provide a container for a printhead having ink therein, the container adapted to prevent leakage of the ink from the printhead during transportation or storage of the printhead.

With this object in view, the present invention resides in, for use in association with a printer, a container for a fluid-carrying body having a channel terminating in an orifice, the channel having a fluid therein, the container comprising an enclosure surrounding the fluid-carrying body, said enclosure capable of being pressurized to a predetermined internal pressure, the internal pressure acting on the fluid to retain the fluid in the channel, so that the fluid is prevented from flowing along the channel and through the orifice.

A feature of the present invention is the provision of an enclosure surrounding an inkjet printhead for pressurizing the printhead, so that ink does not leak therefrom during transportation or storage of the printhead.

An advantage of the present invention is that an ink reservoir belonging to the printhead is filled before the printhead is shipped to the user in order to avoid inadvertent introduction of air bubbles and debris into the reservoir which may otherwise occur if the reservoir is filled by the user.

Another advantage of the present invention is that use thereof avoids need to apply adhesive tape and thus avoids damage to the nozzle plate and MEMS by avoiding deposit of residual amounts of adhesive on the nozzle plate as the adhesive tape is removed therefrom.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

Figure 1:
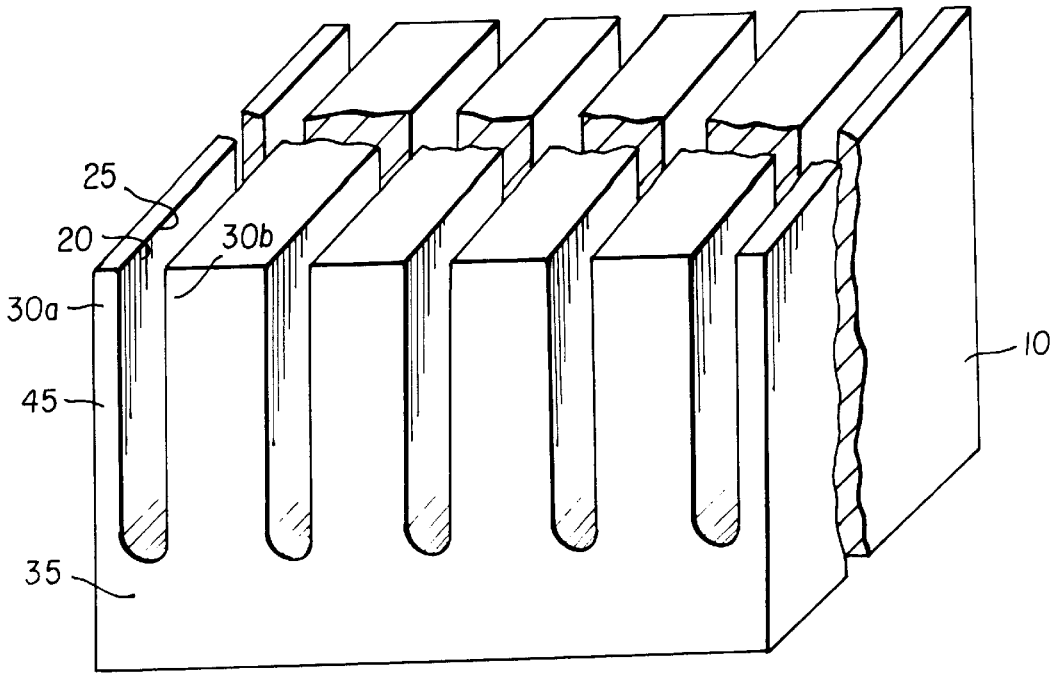
FIG. 1 is a view in perspective of an ink jet printhead, with parts removed for clarity.
Figure 2:
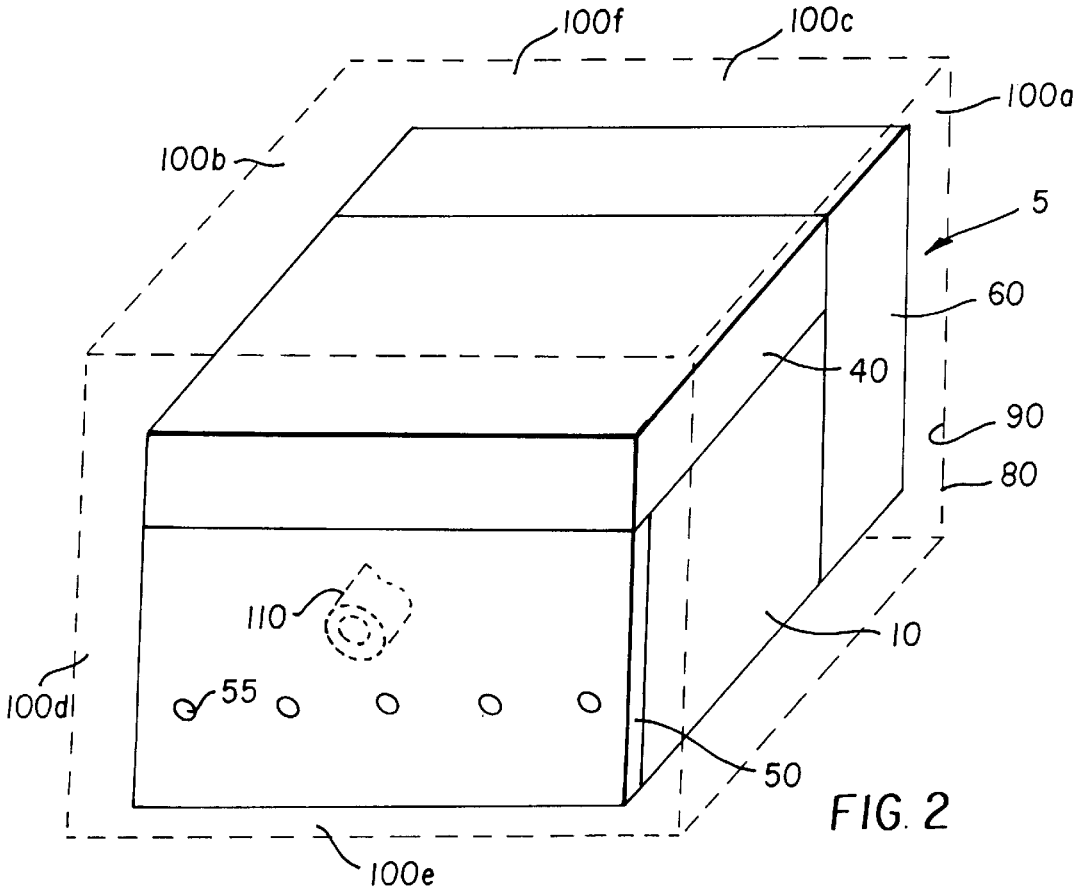
FIG. 2 is a view in perspective of the printhead surrounded by a first embodiment pressurized enclosure shown in phantom, the printhead having a nozzle plate present, which nozzle plate has a plurality of nozzle orifices formed therein.
Figure 3:
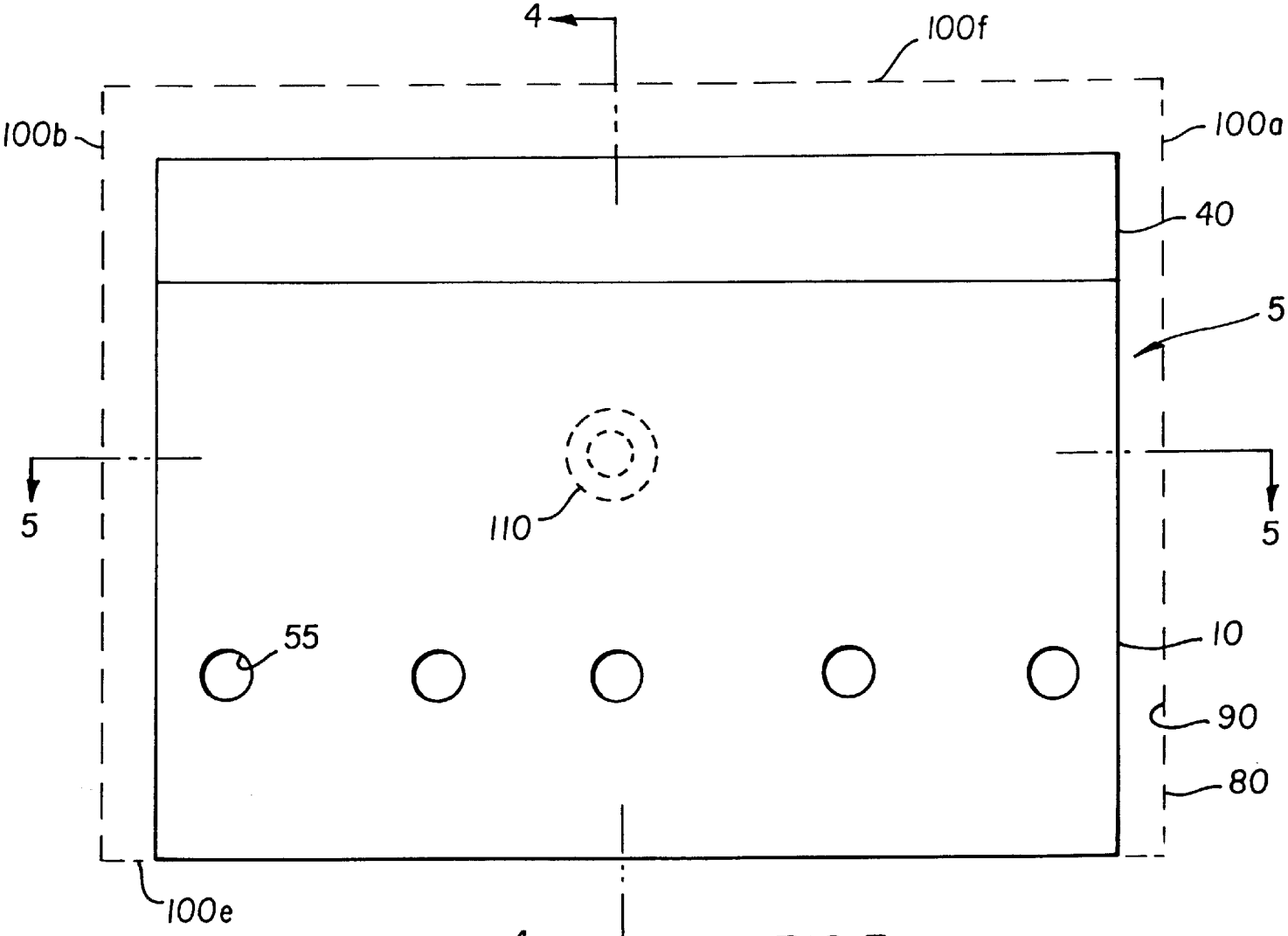
FIG. 3 is a view in elevation of the printhead surrounded by the enclosure.

The present description will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3 and 4, there is shown a fluid-carrying body, such as a printhead, generally referred to as 5. Printhead 5 comprises a printhead body 10 having a plurality of elongated parallel ink channels 20 extending therethrough. Each channel 20 has ink 23 therein. More specifically, each channel 20 is defined by an open side 25, opposing sidewall portions 30*a* and 30*b*, and a base portion 35 interconnecting sidewall portions 30*a* and 30*b*. A top plate 40 sealingly caps all channels 20 and open sides 25, so that ink 23 is prevented from escaping channels 20 by way of open sides 25. In addition, printhead body 10 has a front surface 45 to which a nozzle plate 50 is sealingly attached. Nozzle plate 50 is sealingly attached to printhead body 10 in a manner that prevents ink 23 from leaking from printhead 5 at the interface defined by printhead body 10 and nozzle plate 50. Nozzle plate 50 includes a plurality of generally circular nozzle orifices 55 therethrough of predetermined nozzle radius "Nr," each orifice 55 being aligned with a respective one of channels 20. A purpose of orifice 55 is to control direction of an ink droplet (not shown) to be ejected from orifice 55, so that the ink droplet is ejected generally perpendicularly with respect to nozzle plate 50 in order to form a suitable image (not shown) on a receiver (also not shown). Moreover, a single ink reservoir 60 defining a cavity 65 therein in communication with all channels 20 is provided for holding a supply of ink 23. In addition, an opening 67 is formed in reservoir 60 for allowing ink 23 to be supplied into cavity 65. A plug 69 is sized to sealingly engage opening 67 after a desired amount of ink 23 is supplied into cavity 65. Thus, it may be appreciated that, once ink 23 is loaded into cavity 65, ink 23 will flow from reservoir 60 and into channels 20. This ink 23 in channels 20 is ejected from orifices 55 during operation of printhead 5, which occurs when printhead 10 is disposed in a suitable printer apparatus (not shown).

It is known that when printhead 5 is shipped to a user for first use, it is preferable that ink 23 already be present in cavity 65 for user convenience. This is preferable to requiring the user to load ink 23 into reservoir 60, which would inconvenience the user. Also, it is desirable to fill printhead 5 with ink 23 prior to shipment of printhead 5 in order to avoid introduction of air bubbles and debris into reservoir 60 by the user. However, loading printhead 5 with ink 23 before shipment may result in leaking of ink through orifices 55 during transit or storage of printhead 5. It is therefore highly desirable to prevent leakage of ink 23 from printhead 5 during transit or storage of printhead 5.

Figure 4:
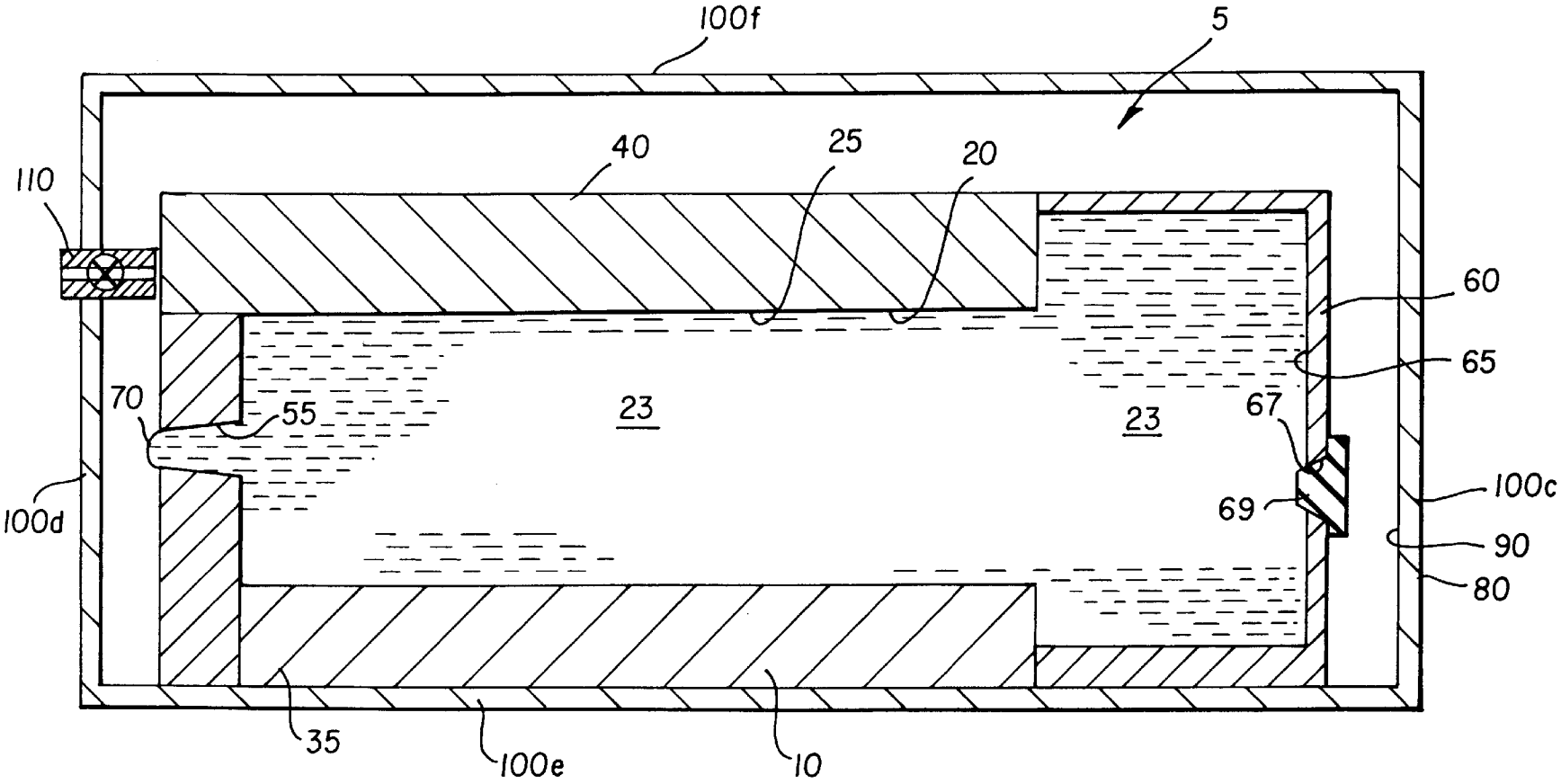
FIG. 4 is a view along section line 4—4 of FIG. 3.
Figure 5:
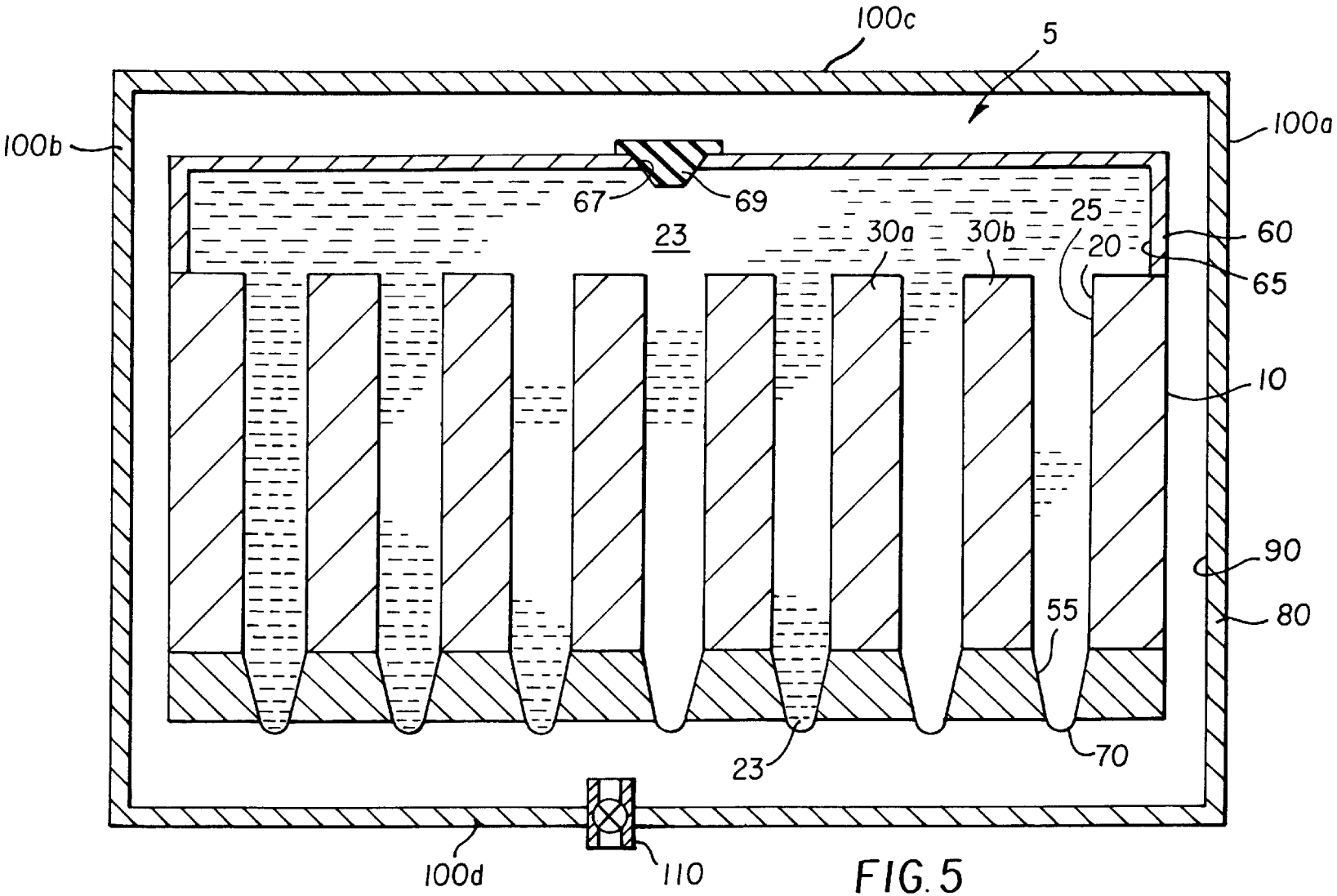
FIG. 5 is a view along section line 5—5 of FIG. 3.
Figure 6:
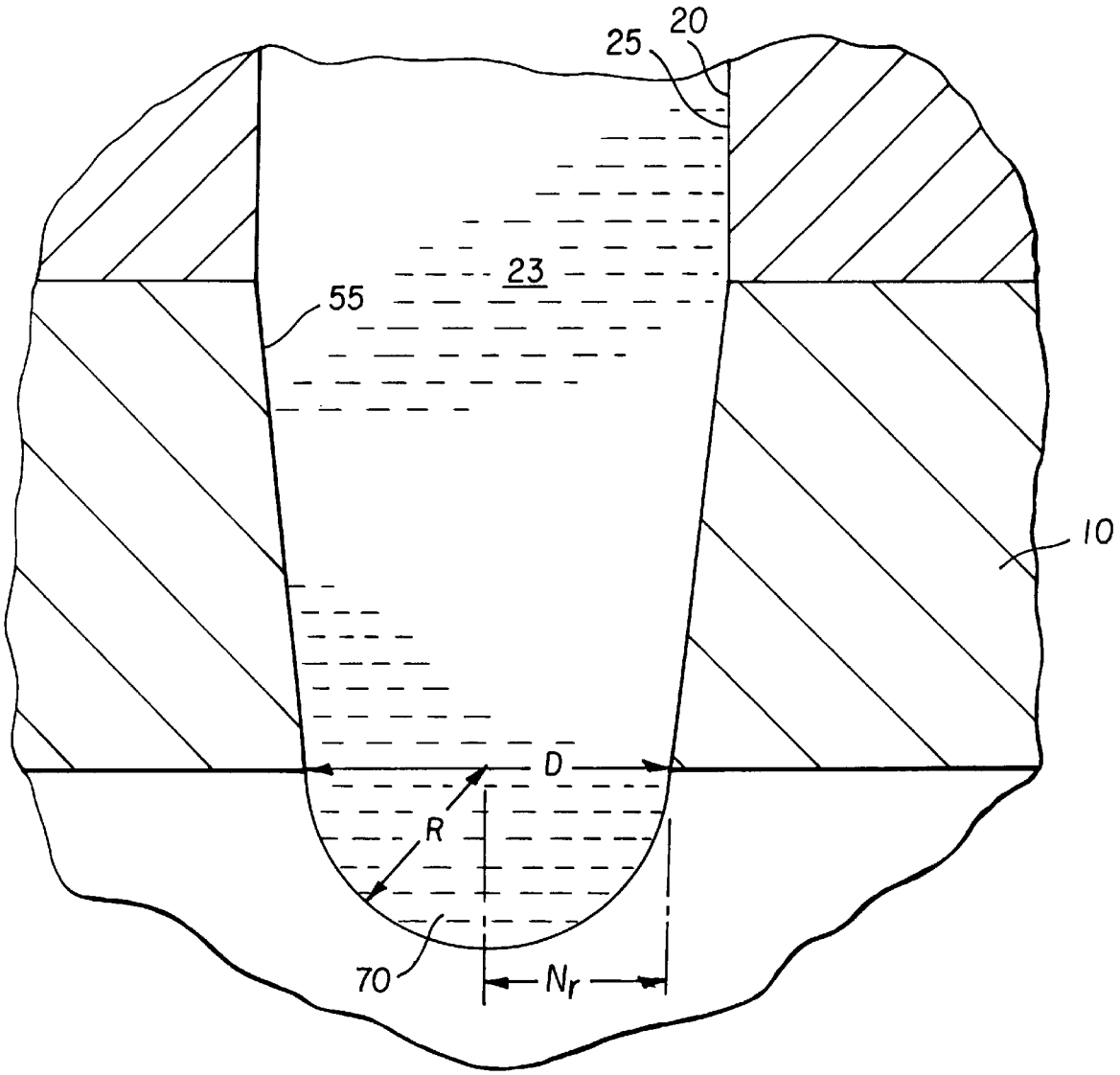
FIG. 6 is an enlarged fragmentation view in vertical section of one of the nozzle orifices and adjacent structure.

Referring to FIGS. 4, 5 and 6, it has been observed that an ink meniscus 70 of radius "R" will form at each of orifices 55 when printhead 5 is loaded with ink 23 prior to shipment. Unless proper precaution is taken, ink 23 will leak, seep and/or weep from orifices 55 because pressure inside reservoir 60 and channels 20 may in some circumstances equal or exceed the pressure outside reservoir 60 and channels 20. For example, if reservoir 60 is filled at atmospheric pressure, at sea level, then the atmospheric pressure acting on reservoir 60 and channels 20 is defined herein as $P_{atm}$ (equal to 33.5 feet of water, or 100 Kilo Pascals (KPa)). The pressure inside reservoir 60 and channel 20 at meniscus 70 will equal:

$$P=P_{atm}+(\rho\cdot g\cdot h) \qquad \text{Equation (1)}$$

where,

ρ is ink density;

g is the acceleration of gravity, and h is the vertical height of liquid ink above meniscus 70.

Now, if the pressure $P_{atm}$ outside meniscus 70 is reduced, meniscus 70 will outwardly bulge as shown in FIG. 6. A maximum pressure difference Δρ sustainable by orifice 55 without ink leakage is 4γ/DD $$\Delta\rho=4\gamma/D \qquad \text{Equation (2)}$$

where,

γ is the surface tension of the ink, and

D is the diameter of the orifice.

For example, if D is 40 micro-meters, and if the ink properties are similar to water, then the maximum pressure drop is about 7.5 KPa at sea levels. However, if printhead 5 is being transported in an airplane at about 30,000 feet, then the pressure drop from sea level is about 30 KPa. Since this is much higher than 7.5 KPa, ink will freely flow from printhead 5, which is a highly undesirable result.

Thus, enclosure 80, being leakproof, protects the open nozzles 55 from external pressure drops due, for example, to transportation at high altitudes. The amount of excess pressurization of the package interior over the pressure at which the reservoir is filled and capped, can be taken as equal to or greater than the maximum vertical ink height over the nozzle attainable by reorientation of package in transit; for example 0.6–60 inches of water, or 0.15–15 KPa This will cause the meniscus to be flat, or somewhat retracted into the nozzle during the transport, and will prevent undesirable ink low or leakage.

It would therefore be desirable to maintain pressure acting on printhead 5 substantially above atmospheric pressure in order to prevent leakage of ink 23 from printhead 5. Pressure higher than atmospheric pressure will also act on meniscus 70, thereby retarding separation of menisci 70 from orifices 55. This, in turn, retards leaking, seeping and/or weeping of ink 23 from printhead 5.

Therefore, referring to FIGS. 2, 3, 4 and 5, a leak-tight container, comprising an enclosure 80 defining an interior 90 therein, surrounds printhead 5. In the preferred embodiment of the invention, enclosure 80 is in the shape of a rectangular parallelepiped. However, it may be appreciated that enclosure 80 may be of other suitable shapes, as well. For example, enclosure 80 may be in the shape of a cube. In the case when enclosure 80 is a rectangular parallelepiped or cube, enclosure 80 includes two oppositely disposed parallel side panels 100*a* and 100*b* interconnected by a rear panel 100*c* orthogonal to side panels 100*a*/100*b*, and a front panel 100*d* disposed parallel to rear panel 100*c*. Rear panel 100*c* and front panel 100*d* are sealingly attached to side panels 100*a* and 100*b*. Enclosure 80 also includes a bottom panel 100*e* sealingly attached to side panels 100*a*/*b*, rear panel 100*c* and front panel 100*d*. Bottom panel 100*e* supports printhead 5 thereon. Moreover, disposed opposite and parallel to bottom panel 100*e* is a top panel 100*f*, which top panel 100*f* is sealingly connected to side panels 100*a*/*b*, rear panel 100*c* and front panel 100*d*. In this regard, top panel 100*f* is preferably capable of being sealingly closed after disposing printhead 5 in enclosure 80 and also capable of being opened for retrieval of printhead 5 from enclosure 80. In this regard, any suitable means may be used to allow opening and closing of top panel 100*f*, such as a suitable hinge and latch mechanism (not shown). Such a hinge and latch mechanism should be capable of allowing top panel 100*f* to be sealingly latched to side panels 100*a*/*b*, rear panel 100*c* and front panel 100*d*. Also, enclosure 80 may be made of a light-weight and structurally rigid polymer for ease of transportation and protection of printhead 5. Moreover, enclosure 80 may be either disposable or reusable.

Still referring to FIGS. 2, 3, 4 and 5, a "one-way" valve 110 is integrally connected to front panel 100*d*. Valve 110 is in communication with interior 90 of enclosure 80 for ingress of a pressurizing medium, such as air or other gas, into interior 90. Presence of valve 110 allows sustained pressurization of enclosure 80, as described in more detail presently. In this regard, valve 110 is adapted to be connected to a source (not shown) of the pressurizing medium which flows through valve 110 and into interior 90. However, one-way valve 110 prevents the pressurizing medium from escaping interior 90 through valve 110. Thus, one-way valve 110 allows one-way flow of the pressurizing medium into interior 90, but prevents reverse flow of the pressurizing medium from interior 90. In this manner, interior 90 is capable of being pressurized to a predetermined pressure above atmospheric pressure. In this regard, valve 110 may be a one-way valve of the kind found in sport balls such as football and basketball.

Figure 7:
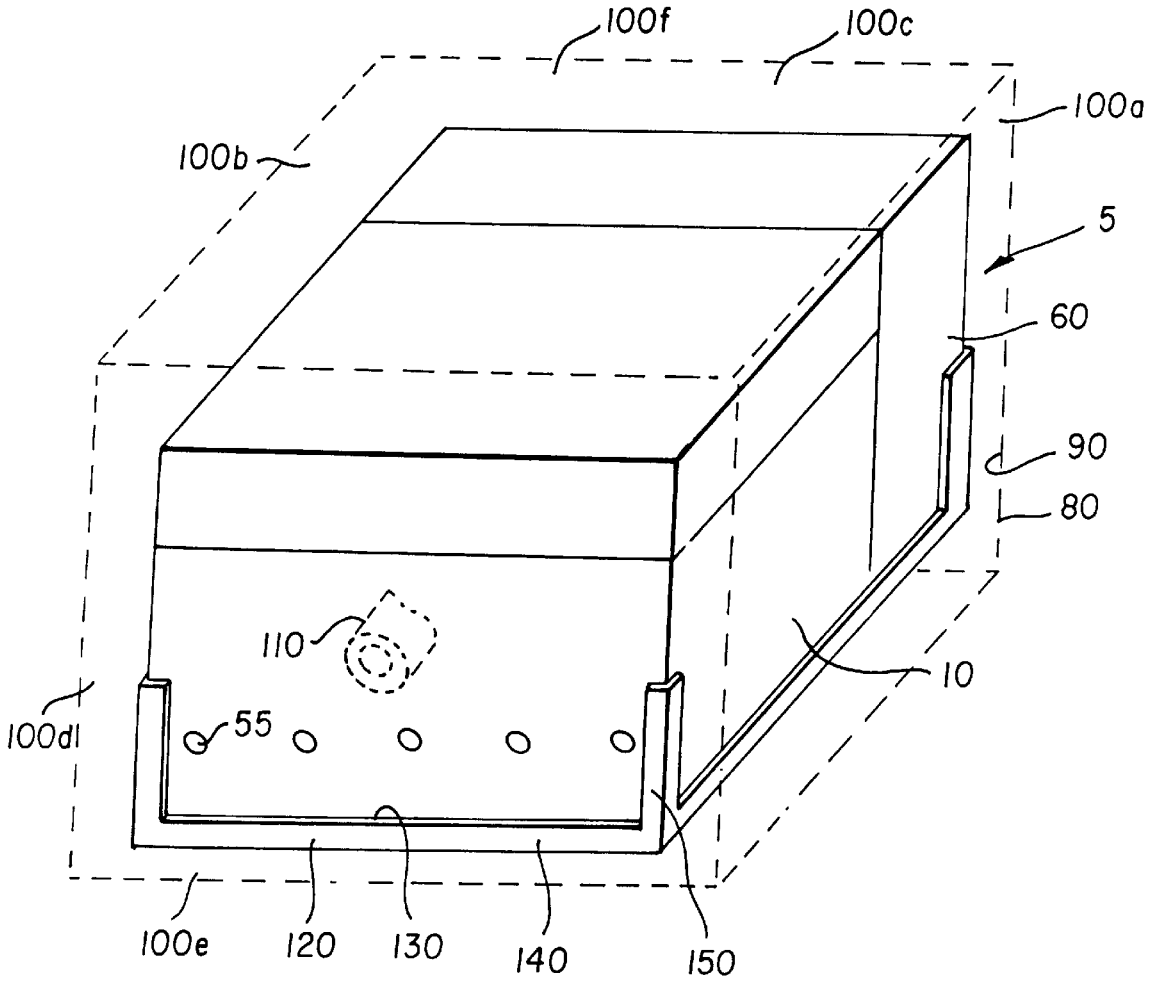
FIG. 7 is a view in perspective of a second embodiment of the enclosure surrounding the printhead, this second embodiment including a support frame for constraining lateral movement of the printhead.
Figure 8:
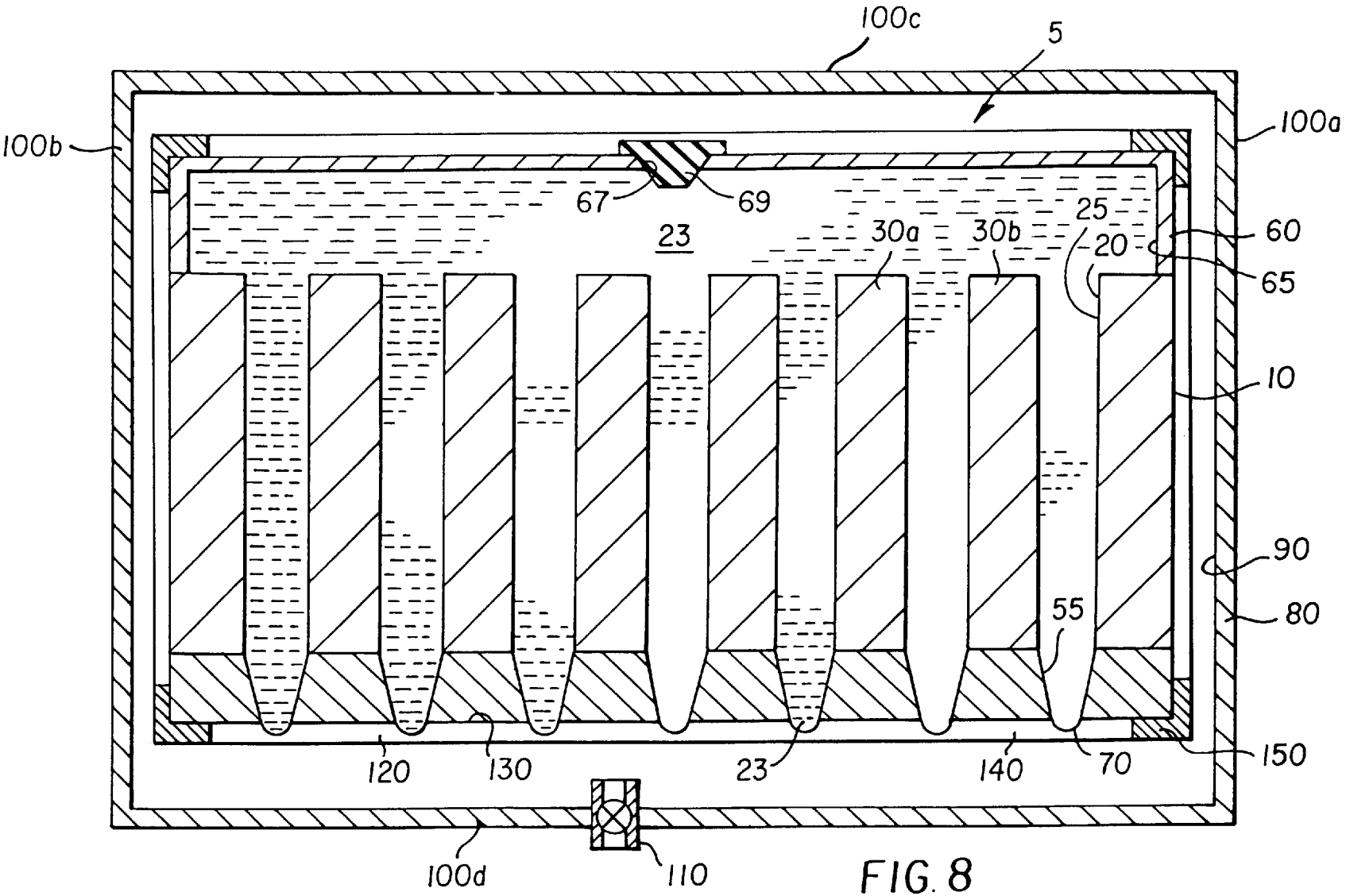
FIG. 8 is a view in horizontal section of the second embodiment of the invention.

Turning now to FIGS. 7 and 8, there is shown a second embodiment enclosure 80. This second embodiment enclosure 80 is substantially identical to the first embodiment enclosure 80, except that enclosure 80 now includes a support frame 120 defining a well 130 sized to matingly receive printhead 5 for constraining lateral movement of printhead 5 during transport of enclosure 80. It is important that movement of printhead 5 be constrained. This is important to avoid damage to printhead 5 during transport of enclosure 80. In this regard, frame 120 comprises a foundation 140 integrally attached to bottom panel 100*e*. Frame 120 also comprises a plurality of upright flanges 150 Foundation 140 and flanges 150 together define the previously mentioned well 130 that matingly receives printhead 5. It may be understood that frame 120 may take any one of many possible structural configurations, the configuration disclosed herein being exemplary only.

Thus, it may be appreciated from the teachings herein, that an advantage of the present invention is that an ink reservoir belonging to the printhead is filled before shipping to the user in order to avoid inadvertent introduction of air bubbles and debris into the reservoir, which may otherwise occur if the reservoir is filled by the user. This is so because pressure in the enclosure is high enough to prevent leakage of ink from the printhead during transportation or storage of the printhead.

It may be further appreciated from the teachings herein, that another advantage of the present invention is that use thereof avoids damage to the nozzle plate and deposit of residual amounts of adhesive on the nozzle plate when adhesive tape is removed therefrom. This is so because use of the invention obviates need to use adhesive tape to prevent ink leakage from the printhead.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, the enclosure may be an inflatable polymer bag rather than a rigid polymer structure to reduce material costs and manufacturing costs for the enclosure.

Therefore, what is provided is a container and method for a printhead having ink therein, the container adapted to prevent leakage of the ink from the printhead during transportation or storage of the printhead.

PARTS LIST

D . . . diameter of nozzle orifice
Nr . . . orifice radius
R . . . radius of ink meniscus
5 . . . printhead
10 . . . printhead body
20 . . . ink channels
23 . . . ink
25 . . . open side of ink channel
30*a*/*b* . . . sidewall portions
35 . . . base portion
40 . . . top plate
45 . . . front surface of printhead body
50 . . . nozzle plate
55 . . . orifices
60 . . . ink reservoir
65 . . . cavity
67 . . . opening
69 . . . plug
70 . . . meniscus
80 . . . enclosure
90 . . . interior of enclosure
100*a*/*b* . . . side panels
100*c* . . . rear panel
100*d* . . . front panel
100*e* . . . bottom panel
100*f* . . . top panel
110 . . . valve
120 . . . support frame
130 . . . well
140 . . . foundation
150 . . . flanges

What is claimed is:

1. For use in association with a printer, a container for a fluid-carrying body having a channel terminating in an orifice, the channel having a fluid therein, the container comprising an enclosure surrounding the fluid-carrying body, said enclosure defining an interior thereof pressurized to a predetermined internal pressure, the internal pressure acting on the fluid to retain the fluid in the channel, so that the fluid is prevented from flowing along the channel and through the orifice; and a valve disposed in communication with the interior of said enclosure for ingress of a pressurizing medium into the interior of said enclosure to allow pressurization of said enclosure.

2. The container of claim 1, further comprising a support disposed in said enclosure and integrally connected thereto, said support being adapted to matingly receive the fluid-carrying body for constraining movement of the fluid-carrying body.

3. A container for a printhead, comprising:

(a) a printhead body having an ink channel having ink therein, the channel terminating in an orifice;

(b) an enclosure surrounding said printhead body, said enclosure defining an interior thereof pressurized to a predetermined internal pressure, the internal pressure acting on the ink to retain the ink in the channel, so that the ink is prevented from flowing along the channel and through the orifice; and (c) a valve disposed in communication with the interior of said enclosure for ingress of a pressurizing medium into the interior of said enclosure to allow pressurization of said enclosure.

4. The container of claim 3, wherein said valve is a one-way valve to allow sustained pressurization of said enclosure.

5. The container of claim 3, further comprising a support frame disposed in said enclosure and integrally connected thereto, said frame defining a well sized to matingly receive said printhead body for constraining movement of said printhead body while said printhead body is disposed in the interior of said enclosure.

6. The container of claim 3, wherein said enclosure is capable of being pressurized to the predetermined internal pressure of between approximately 0.15 KPa and approximately 15.0 KPa.

7. For use in association with a printer, a container method for containing a fluid-carrying body having a channel terminating in an orifice, the channel having a fluid therein, the container method comprising the steps of surrounding the fluid-carrying body with an enclosure, the enclosure defining an interior thereof pressurized to a predetermined internal pressure, the internal pressure acting on the fluid to retain the fluid in the channel, so that the fluid is prevented from flowing along the channel and through the orifice; and disposing a valve in communication with the interior of the enclosure for ingress of a pressurizing medium into the interior of the enclosure to allow pressurization of the enclosure.

8. The method of claim 7, further comprising the step of disposing a support in the enclosure and integrally connecting the support thereto, the support being adapted to matingly receive the fluid-carrying body for constraining movement of the fluid-carrying body.

9. A container method for containing a printhead body, comprising the steps of surrounding the printhead body with an enclosure, the printhead body having an ink channel having ink therein, the channel terminating in an orifice, the enclosure defining an interior thereof pressurized to a predetermined internal, the internal pressure acting on the ink to retain the ink in the channel, so that the ink is prevented from flowing along the channel and through the orifice; and disposing a valve in communication with the interior of the enclosure for ingress of a pressurizing medium into the interior of the enclosure to allow pressurization of the enclosure.

10. The method of claim 9, wherein the step of disposing a valve comprises the step of disposing a one-way valve to allow sustained pressurization of the enclosure.

11. The method of claim 9, further comprising the step of disposing a support frame in the enclosure and integrally connecting the support frame thereto, the frame defining a well sized to matingly receive the printhead body for constraining movement of the printhead body while the printhead body is disposed in the interior of the enclosure.

12. The method of claim 9, wherein the step of surrounding the printhead body with the enclosure comprises the step of surrounding the printhead body with an enclosure capable of being pressurized to the predetermined internal pressure of between approximately 0.15 KPa and approximately 15.0 KPa.

* * * * *